US005849086A

United States Patent [19]

Boelkins

[11] Patent Number: 5,849,086

[45] Date of Patent: Dec. 15, 1998

[54] CONTACT LUBRICATOR WITH METERED SUPPLY

[76] Inventor: Charles W. Boelkins, 1188 Kirk Dr. SE., Grand Rapids, Mich. 49546

[21] Appl. No.: 858,088

[22] Filed: May 16, 1997

Related U.S. Application Data

[62] Division of Ser. No. 570,806, Dec. 12, 1995, Pat. No. 5,690,738, which is a continuation of Ser. No. 157,923, Nov. 24, 1993, abandoned.

[51] Int. Cl.[6] ..... B05C 1/00

[52] U.S. Cl. ..... 118/683; 118/227; 118/249; 118/253; 118/255; 118/259; 118/266

[58] Field of Search ..... 118/249, 253, 118/255, 259, 266, 683, 227

[56] References Cited

U.S. PATENT DOCUMENTS

| | | | |
|---|---|---|---|
| 2,189,765 | 2/1940 | Takats | 101/132.5 |
| 2,390,001 | 11/1945 | Schindler | 118/674 |
| 2,611,336 | 9/1952 | Sachs | 118/227 |
| 2,614,526 | 10/1952 | Zaber et al. | 118/122 |
| 2,633,822 | 4/1953 | Watterson, Jr. | 118/227 |
| 2,870,737 | 1/1959 | Byrnes | 118/227 |
| 2,894,481 | 7/1959 | Stuchbery | 118/681 |
| 3,379,170 | 4/1968 | Thomas et al. | 118/259 |
| 3,416,489 | 12/1968 | Hoffmann | 118/227 |
| 3,805,738 | 4/1974 | Kitazawa | 118/227 |
| 4,029,833 | 6/1977 | Kosta | 427/428 |
| 4,641,404 | 2/1987 | Seydel et al. | 28/178 |
| 4,856,966 | 8/1989 | Ozawa | 417/214 |
| 5,254,108 | 10/1993 | Burrell et al. | 604/289 |
| 5,395,447 | 3/1995 | Wu | 118/227 |
| 5,476,546 | 12/1995 | Zibulla | 118/668 |

FOREIGN PATENT DOCUMENTS

| | | |
|---|---|---|
| A10235425 | 9/1987 | European Pat. Off. . |
| C14105364 | 5/1992 | Germany . |
| WO9100150 | 1/1991 | WIPO . |

OTHER PUBLICATIONS

Copy of Sales Brochure "Strip and Sheet Stock Oliers" (1989) from Stamping Specialty Co., Inc., 2401 N. Ritter Ave., Indianapolis, Indiana 46218.

*Primary Examiner*—Laura Edwards
*Attorney, Agent, or Firm*—Price, Heneveld, Cooper, DeWitt & Litton

[57] ABSTRACT

Apparatus for applying liquid to a workpiece surface by contact, including at least one freely rotatable roller having a cylindrical outer wall whose surface is arranged to contact workpieces or workstock, including elongated sheet stock, and to be rotatably moved thereby while transferring liquid to the surface of the workstock or workpiece by contact. The apparatus includes a source or supply of the liquid to be applied and a controllable liquid-dispensing device connected between the source and the roller for conveying desired quantities of liquid from the source to the roller, and also includes means for controlling the liquid-dispensing apparatus in response to roller rotation such that predetermined quantities of liquid are provided from the source in direct relation to the roller movement caused by the advancing workpieces or workstock. In a preferred embodiment, the roller is generally hollow and includes a series of internal spray orifices which discharge the liquid conveyed to the roller from the source outwardly into the interior of the roller, for contact with the inside periphery of the cylindrical roller wall. The roller wall is perforate in nature and has sufficient liquid-carrying capability to transfer the liquid from its inside periphery to its outside periphery while also dispersing it around and along the roller surface for transfer to the advancing workpieces as the roller rotates in contact therewith.

10 Claims, 4 Drawing Sheets

CONTACT LUBRICATOR WITH METERED SUPPLY

This is a division of application Ser. No. 08/570,806, filed on Dec. 12, 1995, now U.S. Pate. No. 5,690,738, which is a continuation of Ser. No. 08/157,923 filed on Nov. 24, 1993 and now abandoned.

FIELD OF INVENTION

This invention relates to apparatus for applying a film of liquid to the surface of a workpiece by contact transfer, and more particularly to a device of this type which utilizes one or more roller members for rotatably contacting the workpiece as it is advanced for manufacture or finishing and transferring a desired liquid to the surface of the workpiece during such contact. In addition, the invention relates to liquid applicators of this general type which provide accurately metered supply of the lubricant to be applied, such that the amount so applied is accurately controlled and regulated, preferably by use of a positive-displacement pump for repeatably metering out and directing metered volumes of the liquid to the applicator members, whether rollers or otherwise. The apparatus may include oppositely disposed applicators such as rollers, which contact the workpiece from opposite sides, to apply the liquid to both such sides, and in this configuration the invention provides means by which a single such pump may be utilized to provide adjustable and relatively variable amounts of the liquid to each of two such opposed applicator members. Accordingly, the invention also relates to means for providing metered amounts of such liquid to the applicator members of contact-type liquid dispensers.

BACKGROUND

Many different industrial processes involve a continuously-advancing supply of material which is machined and processed in various ways to produce finished products, for example, sheet metal and other such stock which progressively advances through various formative stages. Throughout these different stages of manufacture, the continuously-advancing stock often requires the application of liquid lubricants, coolants and the like, and the same is sometimes true with respect to individual workpieces which progress as a continuing stream through various additional processing steps. At times, such liquid lubricants and the like may be applied as a spray or mist, but in other instances it is more advantageous to transfer the liquid by contact with an applicator member which makes contact with the advancing workpieces as they pass a particular location.

One form of such an applicator device which has demonstrated its suitability for such processes is a roller, typically covered on its surface by some relatively soft material (e.g., felt or carpet stock) which will absorb and hold a certain amount of the liquid and readily transfer it by contact to the workpiece as it passes by the roller.

In most instances, the liquid lubricant or the like is applied to such rollers from the outside, by spraying the roller surface or by disposing a drip tube above it from which liquid may fall by gravity onto the surface of the roller. Sometimes, the roller is mounted above a supply tank or container in which the liquid is maintained at a level sufficiently high to contact the roller as it rotates in contact with the workpiece or stock. In either such case, the supply of liquid to the roller is not subject to careful or precise control, and in order to avoid running dry, the supply is usually maintained at a level sufficient to produce an excess on the roller, thereby inevitably causing spatter and throw-off of liquid from the roller and producing a corresponding messy and contaminated area which necessitates various other measures and expense, as well as wasting the liquid and, frequently, applying an undesirable excess amount to the workpiece or stock.

BRIEF SUMMARY OF THE INVENTION

The present invention provides a new and improved form of contact liquid applicator for installations and uses of the above type, by which the indicated problems known in the prior art are resolved advantageously and effectively, as well as in a desirable cost-effective manner.

From a first perspective, the invention provides a new and accurately controlled surface applicator which utilizes a repeating cyclical positive-displacement pump for metering out accurate and controlled amounts of the liquid to the applicator member on an ongoing basis, such that the applicator member carries a predetermined amount of the liquid on its surface for transfer to the workpiece. In instances where (as is often true) the apparatus utilizes a pair of applicator members in mutually opposed and narrowly spaced relation, with the workpiece passing between the applicators, the invention provides means for proportionally varying the metered output of the pump so as to apply predetermined portions thereof to each of the two such applicators in a set thereof.

From another perspective the invention provides a new and advantageous structural configuration for such contact applicators, particularly suitable for applying liquid lubricants and the like in large-area surface applications, wherein at least one of the applicator members comprises a roller which is arranged to be contacted by and rotate with the advancing workpieces or stock and to apply the liquid lubricant or the like to surfaces of the workpiece or stock by contact therewith, and wherein such roller has a liquid-transmissible peripheral wall and the liquid is provided to the interior of the roller under pump pressure, from where it is distributed to the interior of the liquid-transmissible wall for conveyance through the latter to the outer surface, where it forms a dispersion over the entirety of such surface, for uniform application to the advancing workpieces during rotational contact therewith.

In a still further embodiment, the invention provides a surface lubricator for sheet stock and the like having at least one pair of elongated rollers disposed in mutual alignment and closely adjacent relation to receive and pass a workpiece therebetween, wherein at least one of the rollers in the pair is structurally configured to have a generally hollow rigid sleeve-like cylinder with multiple perforations which is readily transmissible by liquid lubricant, and an outer cover of generally resilient material telescoped over and carried on such cylinder. In one particular preferred embodiment, this outer cover is of open-celled foam-type material, although other generally similar media (e.g., felt) may also be used depending upon the circumstances, however, the cover must in any event be readily transmissible by the liquid lubricant, and the apparatus includes means inside the roller for spraying the liquid lubricant outwardly against the porous internal cylinder for migration therethrough to the resilient outer cover, through which the liquid is drawn by capillary action as the film or dispersion of liquid on the outer surface of the resilient cover is continuously depleted by transfer of liquid to the continuously-advancing workpiece.

The foregoing features and attributes of the invention will become increasingly clear upon consideration of the ensuing detailed specification and the attached drawings, depicting certain preferred embodiments of the invention, provided for illustration of the underlying concepts as well as of such particular embodiments.

DESCRIPTION OF PREFERRED EMBODIMENTS

Figure 1:
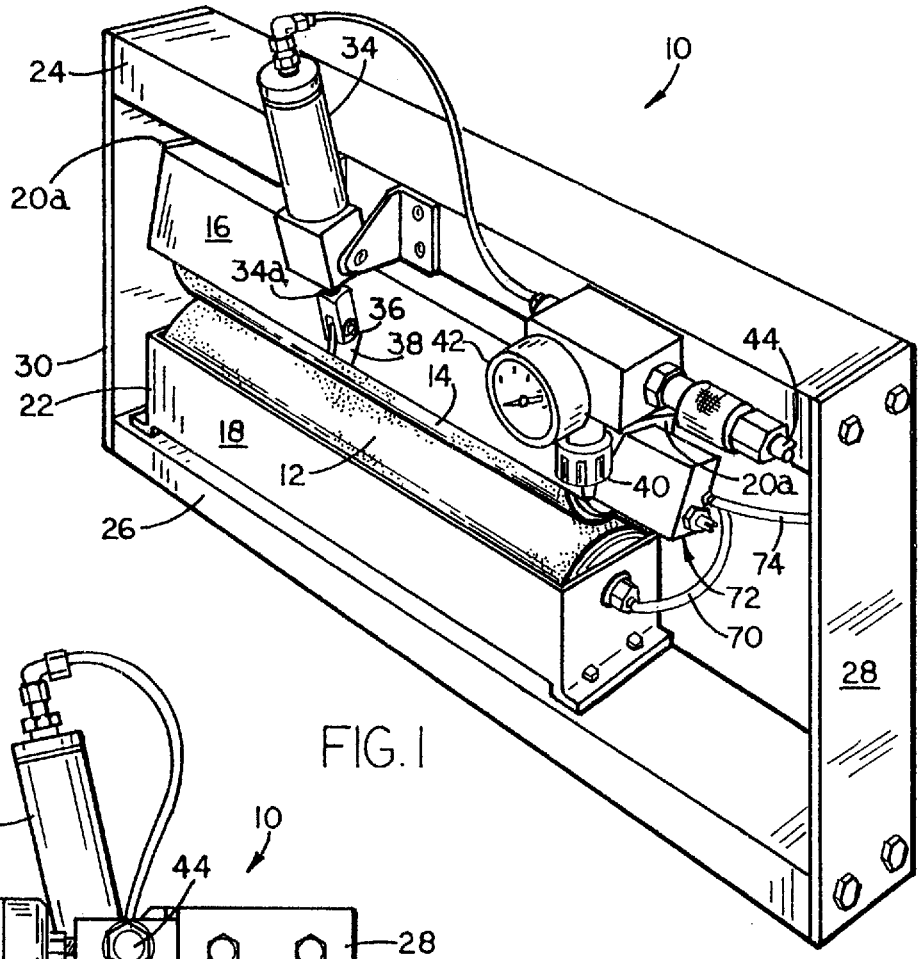
FIG. 1 is a front perspective view showing a first embodiment of the invention.

As may be seen in FIGS. 1, 2, 3 and 4, the first embodiment of the invention comprises a single-station contact applicator 10 which basically includes a pair of vertically opposed, horizontally extending cylindrical rollers 12 and 14 that are mounted within trough-like housings 16, 18, respectively, and supported in position by brackets 20, 22 mounted on and projecting outwardly from upper and lower main supports 24, 26, respectively, that are mounted between end plates 28, 30. As illustrated, all such structural members are securely fastened together, as by the bolts illustrated, to form a rigid frame.

Figure 6:
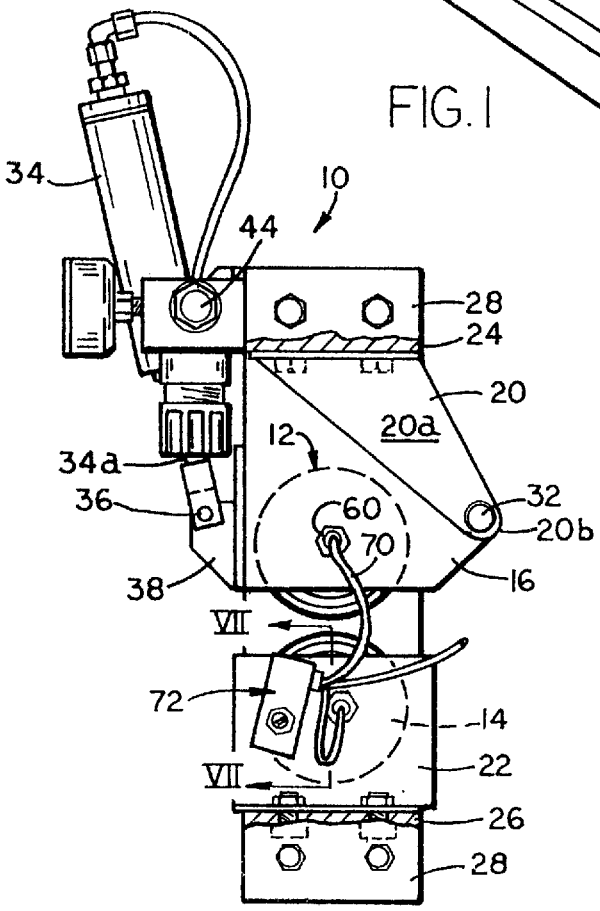
FIG. 6 is an enlarged fragmentary end elevation similar to FIG. 3 showing further details of the structure.
Figure 2:
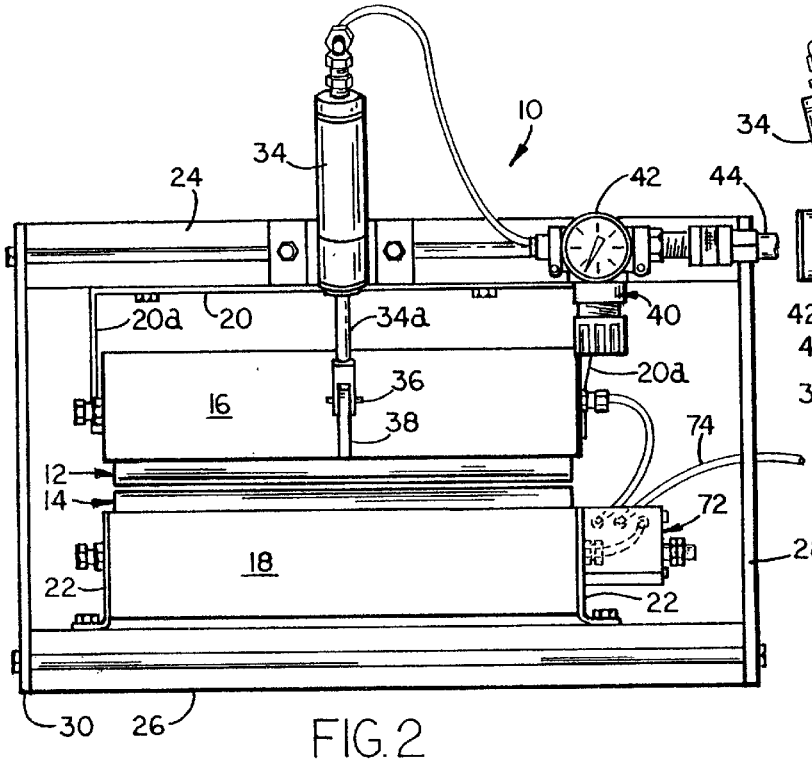
FIG. 2 is a side elevational view of the apparatus shown in FIG. 1.
Figure 3:
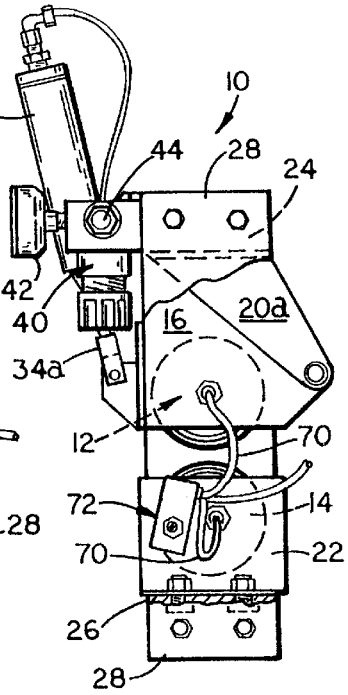
FIG. 3 is a fragmentary end elevation showing the apparatus illustrated in FIGS. 1 and 2, with outer portions broken away to better show certain internal features.

As best seen in FIGS. 3 and 6, the upper mounting bracket 20 is preferably a one-piece U-shaped member with downwardly-depending end extremities 20*a*, which preferably extend laterally from the main support 24 at an angle, to provide an offset mounting extremity 20*b* at their lowermost end. The aforementioned upper roller housing 16 is preferably mounted in a pivotal manner at extremity 20*b* by a pin 32, which thus provides an axle or trunnion about which the upper housing 16 and the roller 12 mounted therewithin may be pivoted so as to move the upper roller 12 toward or away from the lower roller 14. Preferably, such pivotal motion is controlled by a pneumatic cylinder 34 or the like which is mounted on the side of the upper support beam 34 and which has its piston 34*a* pivotally connected by a pin 36 or the like to the upper roller housing 16 by means of an angle bracket 38. Preferably, the pneumatic cylinder 34 is actuated through an adjustable pressure regulator 40 having a gauge 42, such that the amount of pressure applied may be adjusted for different operating conditions, as noted further below. Of course, this requires a pneumatic pressure input, which is supplied through an inlet tube 44 coupled by appropriate fittings to the regulator 40. Thus, pneumatic pressure applied to the inlet 44 at a first level will actuate the cylinder 34 at a second, typically lower and regulated level whereupon cylinder 34 will pivot the upper roller 12 and its housing 16 together in a counterclockwise direction about pin 32, so as to bring the upper roller 12 toward the lower roller 14 and into contact with workpieces, sheet stock, or the like passing between the upper and lower rollers at a predetermined pressure.

Figure 5:
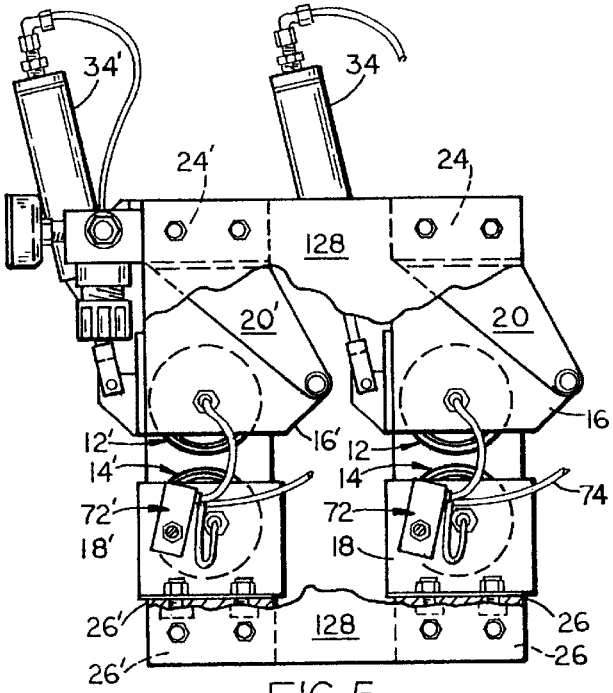
FIG. 5 is a fragmentary end elevation showing the structure illustrated in FIG. 4, with outer portions broken away to better show certain internal features.
Figure 4:
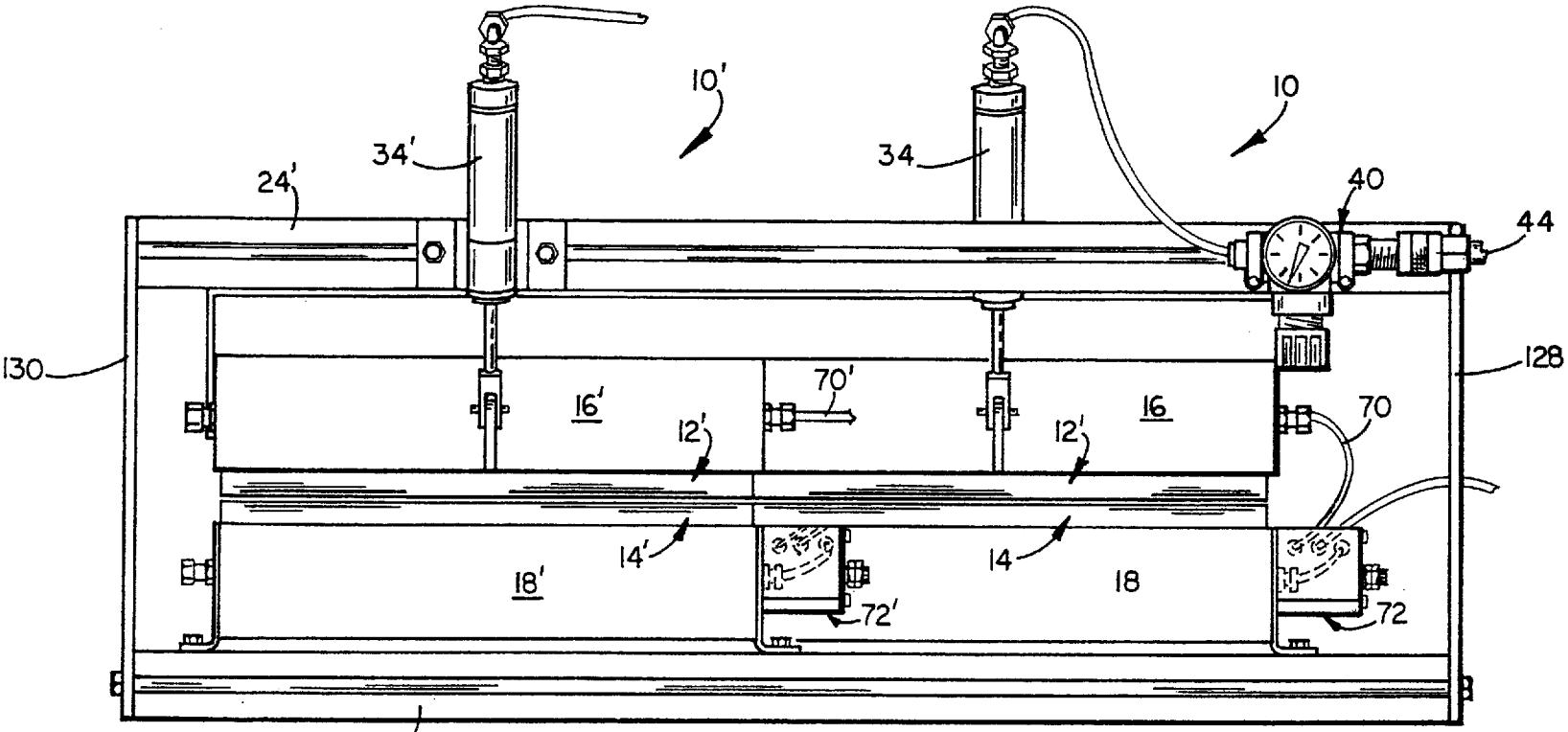
FIG. 4 is a side elevation showing another embodiment or alternative configuration of the invention.

The apparatus 10 described above is designed to be modular in nature and may be readily moved from one location to another, and installed in a variety of different environments to accomplish a variety of different purposes. While the size of such a module may of course be widely varied to accomplish particular purposes and accommodate various working conditions, it may also be ganged together with other like modules to provide operating units of various different widths, to accommodate various lateral areas and various widths of sheet stock, etc. An illustrative such ganged apparatus is shown in FIGS. 4 and 5, wherein a pair of the modules 10, 10' are disposed in laterally adjacent, staggered relationship, such that their respective rollers 12, 12' and 14, 14' are disposed in coplanar relationship with one another but slightly offset laterally from one another.

In this ganged arrangement, each of the adjacent modules 10, 10' may have its own actuator 34, 34' for moving the upper rollers 12, 12' toward and away from the lower rollers 14, 14', although the two different such actuators may if desired be supplied pneumatic actuating pressure by a common regulator 40, particularly, where (as is typically true) simultaneous actuation of the rollers is desired. Alternatively, separate sources and different regulators may be utilized, particularly where non-simultaneous or differing-pressure applications are involved. As will be apparent, other components of the additional (ganged) module 10' which correspond to those of module 10 are designated by primed numbers corresponding to those used in the description of module 10, but end plates 28 and 30 thereof are replaced by directly similar but essentially double-sized end plates 128, 130 which are sized appropriately to mount the multiple modules 10, 10' involved.

Figure 7:
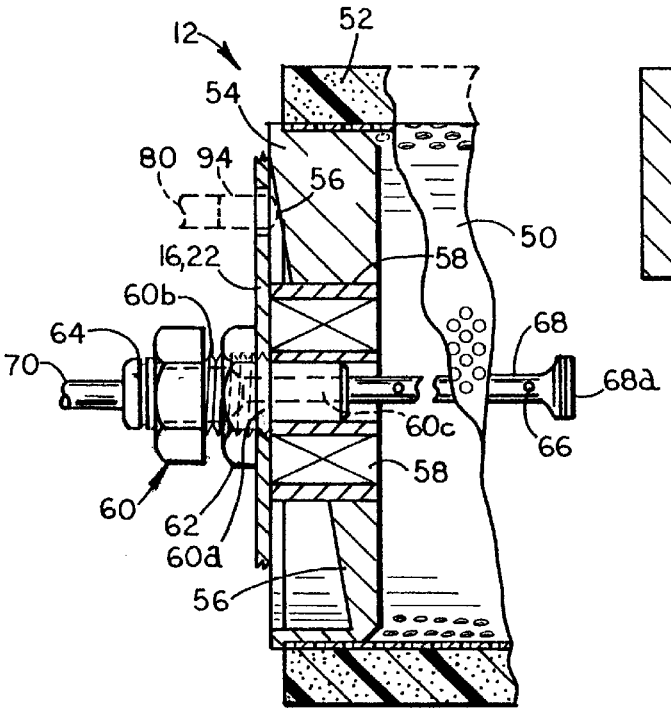
FIG. 7 is a further enlarged fragmentary cross-sectional side elevation, taken along the plane VII—VII of FIG. 6, showing various structural details at one end of a roller, including the mounting thereof.

The preferred structure for each of the rollers 12, 14 is illustrated in more detail in FIG. 7. Each such roller member comprises a cylindrical member having a generally rigid sleeve-like inner support member 50 of sheet metal or the like which is generally of an openwork nature, i.e., having numerous perforations or apertures extending throughout its peripheral wall. Telescoped over the perforate internal cylinder 50 is an outer cover 52 that, in a particular preferred embodiment, is of open-celled polymeric material, e.g., polyurethane foam. While various other materials may be used for the outer member 52, (e.g., resilient felt or the like) it must be moisture-transmissible and is preferably resiliently compressible in nature although it is to be noted that in certain circumstances a more rigid moisture-transmissible member may be utilized instead.

Each end of the perforated cylinder 50 is closed by an end cap 54 (FIG. 7) (one such end being shown for illustration), generally comprising a flat cup-like member in its overall nature, having a central opening for insertion of a bearing 58 by which the cylinder is rotatably mounted. As illustrated, each of the end caps 54 mounts one end of its corresponding roller in a freely rotatable manner, supported upon the adjacent end wall 20*a*, 22*a* of the corresponding roller housing 16, 22. For example, each such end wall may have a mounting aperture at a predetermined position, for receipt of the protruding cylindrical end portion 60*a* of a corresponding fitting 60, with end portion 60*a* providing a trunnion in the form of a stub shaft 60*c* that receives the inside race 58*a* of the bearing 58. Preferably, the end cap 54 is press-fit into the end of the perforate cylinder 50, and the bearing 58 is press-fit into the end cap 54, such that the perforate cylinder 50, outer cover 52 and end cap 54 at each end all rotate with the respective bearings 58, about an axis defined by a pair of oppositely disposed stub shafts 60*c*, which support the roller unit at each opposite end. As illustrated, the central portion 60*b* of each fitting 60 is externally threaded, and carries a corresponding lock nut 62. The aforementioned aperture through the end wall of housing 16 and 18, through which the fittings 60 extend, is internally threaded to engage the threaded outer portion 60*b* of fittings 60, such that when the nuts 62 are then tightened against the face of the aforementioned housing end walls, they will lock the fittings 60 securely in place, thereby correspondingly mounting the roller units 12, 14 in position.

As also illustrated in FIG. 7, at least one of the fittings 60 supporting each roller unit 12, 14 has an axially extending internal passage 60*c* through which liquid may be conveyed. Inside each of the rollers 12, 14, an internal supply tube 68 extends axially between the corresponding stub shaft portions 60*a* of the two oppositely disposed fittings 60 carrying that roller, to convey liquid provided to the internal passage 60*c* by an external supply tube 70 which is disposed in flow communication therewith. Each such internal supply tube 68 has a predetermined number of spray apertures 66, which are preferably sized in accordance with the viscosity and surface tension of the liquid to be dispersed thereby, together with pressure under which such liquid is pumped, to thereby provide a desired spray patter or dispersion condition inside each roller, while at the same time retaining all liquid within tube 68 when the supply pressure is removed from it (i.e., not dripping). The downstream end 68*a* of internal tube 68 will normally be closed, since it typically need not convey liquid onwardly to other stations. Consequently, end 68*a* may merely be crimped off, as shown, or it may, like the upstream end, be press-fitted into the internal passage 60*c* of the corresponding downstream fitting 60, and the passage in the latter suitably closed by a plug or the like.

As indicated, each of the internal tubes 68 is provided liquid to be dispersed inside the rollers 12, 14 by the external supply tube 70 (FIG. 7) and the latter is secured to the fittings 60 in sealed relationship, as for example by a compression coupling 64 which is seated in the fitting 60. The external supply tubes 70 receive the liquid to be dispensed within the rollers 12, 14 from a pump 72 (FIGS. 1, 3, 4, 5 and 6), to which the liquid is supplied from a reservoir (not shown) through a supply tube 74. Pump 72 is preferably self-priming so that the liquid need not be supplied to it under pressure. In the ganged embodiment 10, 10' shown in FIGS. 4 and 5, separate pumps 72, 72' are shown, each for supplying a corresponding roller set 12, 14, although in some applications a single such pump may be used for this purpose, preferably with corresponding flow-dividers of a conventional nature (not shown) that may be adjustable to vary the proportional amount of liquid provided to each roller set as well as to each roller in a set.

Figure 10:
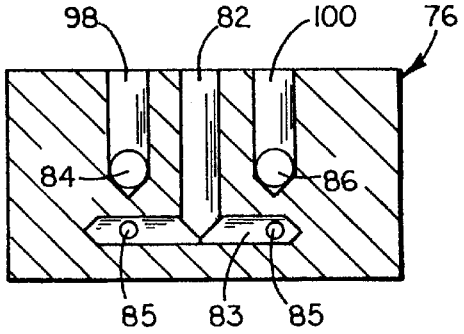
FIG. 10 is a top plan view of the structure shown in FIG. 8.
Figure 8:
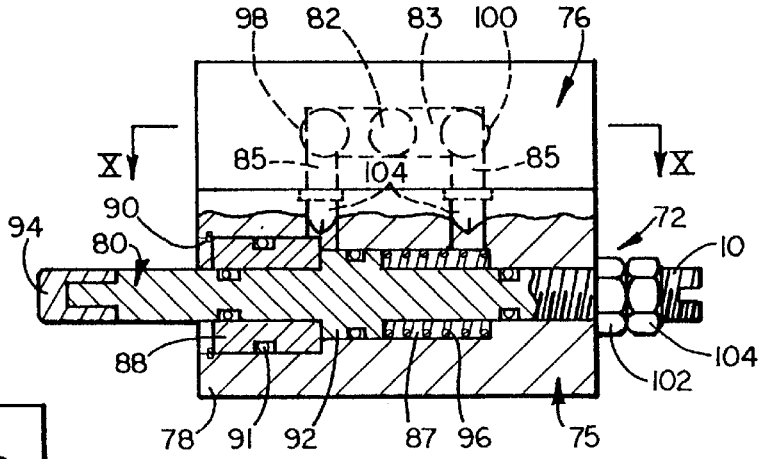
FIG. 8 is a fragmentary side elevational view of a preferred pump for usage in the invention.
Figure 9:
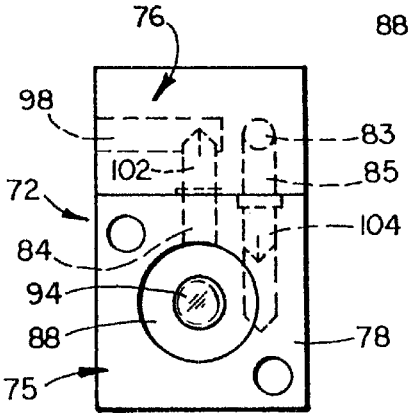
FIG. 9 is an end elevational view of the pump shown in FIG. 8.

The pump 72 is preferably, in accordance with preferred embodiments, a positive-displacement, cyclically operable volumetric metering device, preferably of the type shown in FIGS. 8, 9, and 10. As there illustrated, each such pump unit actually comprises a pump module 75 and a manifold block 76 by which fluid is provided to the pump module 75 and by which its output is distributed. As may be recognized, the preferred pump module 75 is preferably of a type whose overall nature is generally known, comprising a block-like housing 78 having a particularly configured longitudinal internal passage and corresponding piston to positively displace metered amounts of fluid from a metering chamber formed therein. In the embodiment shown, fluid from the external supply which is conveyed to the inlet aperture 82 of manifold 76 by supply tube 74 is routed to the pump module 75 through internal passages 83, 85 and passes into the pump chamber 87, in which the piston 80 is reciprocably disposed. The output of the pump module 75 is ejected through the dual outlet passages 84, 86 and their respective outlet apertures 98, 100, and comprises a continuing succession of precisely metered volumetric quantities.

The internal structure of the particular preferred embodiment of pump module 75 is shown in FIG. 8, where it will be seen that piston 80 is retained in place by annular bushing 88 which also provides a guide through which the forward end of piston 80 is reciprocated. Guide bushing 88 is secured precisely in place by a snap ring 90 or the like and preferably has an annular seal 91 around its outer periphery. Internally, a centrally disclosed pump section 92 of piston rod 80, of enlarged diameter, moves back and forth through the internal metering chamber as a function of mechanical pumping force applied to an outer end portion 94 of the piston rod 80 that preferably carries a replaceable, smoothly rounded bearing cap. Thus, as seen in FIG. 8, piston rod 80 is forced to the right by the application of such pumping forces, against the resilient pressure of a return spring 96 disposed in the pumping chamber, which normally keeps the forward face of the pump section 92 seated against the rearward face of the guide bushing 88.

Accordingly, the supply tube 74 provides the fluid which is to be metered out to the rollers 12, 14 through an inlet aperture 82 in the manifold block 76 (FIGS. 8 and 10), which communicates with an orthogonal passage 83 therewithin leading to the downwardly extending supply passages 85 that connect to the metering chamber within the pump housing 78. As the piston 80 is reciprocated back and forth laterally within the pump housing 78, the pump section 92 of the piston acts to displace a continuous succession of metered quantities of fluid, which are forced outwardly from the metering chamber and into one or the other of the outlet passages 84, 86 that lead to and communicate with the outlet apertures 98, 100 (FIG. 10) in the manifold block 76. More particularly, in the preferred embodiment shown, the pump 72 is double-acting, i.e., each time piston 80 moves to the right (as shown in FIG. 8) it ejects a metered charge of liquid out of the right-hand passage 86 and outlet 100 (FIGS. 9 and 10), as the piston moves to the left it ejects a basically identical charge out passage 84 and outlet 98.

In regard to the pumping action of piston 80 as just described, it should be noted that the pump 75 preferably includes certain check valves, e.g., valves 102, 104, 104' shown in FIGS. 8 and 9, which in this implementation are believed novel. More particularly, each such valve comprises a one-piece elastomeric device of the type known generally as a "Duck-bill" check valve, which is typically used in other types of applications, e.g., on the ends of conduits, etc. Thus, while of a nature generally known in the art, the use of such a device in a pump or the like, such as is illustrated in FIGS. 8 and 9 is believed novel, and contributes valuable efficiencies of manufacture and assembly, as well as good pumping operation. As will be understood, each such device comprises basically a small resilient tube extending from an annular collar at one end, with the other end of the tube forming a slit-like opening in the nature of a pair of lips. Thus, positive pressure from the collar end readily forces the "lips" open to pass fluid, whereas the opposite condition closes the "lips" to block fluid flow. The operation of such check valves to open or close passages 84, 85 and 86 for fluid flow during the pumping strokes of piston 80 is believed to be readily apparent, but it is to be expressly noted that, in accordance with the present invention, the annular collar mentioned above is used as a seal, analogous to an O-ring, between the pump module block 78 and the manifold block 76, thereby obtaining further economic advantage and manufacturing efficiency.

Reciprocation of the pump piston 80 in the aforementioned matter is desirably made to be synchronous with rotation of the rollers 12 and 14, so that the resulting quantities of liquid pumped to the rollers may maintain a predetermined continuous rate of application to the sheet stock or workpiece(s) continuously feeding between the rollers, in a manner that is independent of the workpiece feed rate. By doing so, the supply of liquid to the rollers may be made to be consistent with the transfer of liquid from their surface. While this desired end may be achieved in a number of different ways, one preferred way is to actuate the pump piston 80 directly by one or the other of the rollers themselves, as a function of its rotary movement, and in accordance with a preferred embodiment of the invention this is accomplished by mounting the pump assembly 72 directly adjacent one end of one of the rollers, e.g., the lower roller 14 (FIGS. 2–6) (or the upper roller 12, FIG. 1). By providing an appropriately positioned hole (FIG. 7) through the adjacent end wall of the lower trough or housing 18 (and its mounting bracket portion 22), the outer end portion and bearing cap 94 of the pump piston 80 may engage and ride against the annular interior surface of the adjacent end cap 54 and, by providing a rotary cam surface 56 on end cap 54, in the form of an undulating annular surface, the rotation of the roller unit is transferred directly to the bearing cap 94 on the end of the pump piston 80 thereby pushing the latter inwardly and allowing it to be returned back outwardly by return spring 96 upon each rotation of the roller. Of course, various cam configurations may be imparted to the end cap 94 to accomplish essentially any desired number of pump strokes per revolution (the particular example illustrated in FIG. 7 showing a single such stroke). At the same time, the pump piston motion is made to be synchronous with roller rotation, and it is also made smooth and consistent. As already indicated, pump action may be accomplished in a number of different ways, but the particular embodiment just described has definite advantages since few if any additional parts are needed, the pump-actuating motion is already present by virtue of roller rotation, and the action is positive, foolproof and extremely reliable. In addition, pump operation may readily be altered by substituting other end caps having other cam profiles machined or otherwise formed in them.

As may be seen from the foregoing, the reciprocal movement of the pump piston 80 by the cam surface 56 on end cap 54, and the resulting volume of liquid displaced outwardly by the pump each time the piston is reciprocated is, in the first instance, a direct function of the relative height of the cam surface 56 with respect to that at which the pump piston occupies the position shown in FIG. 8, with pump section 92 seated against the guide bushing 88. That is, the relative height of the cam surface 56 will determine the length of the pump piston stroke and the corresponding distance that the pump section 92 moves in traversing the metering chamber. A further and readily adjustable control over the amount of liquid pumped on each pump stroke is provided by the manually-adjustable nuts 108, 110, since by threading nut 108 further onto the threaded pump piston extremity 106 from the position shown in FIG. 8, the allowable return of the pump piston toward the bushing 88 becomes increasingly reduced, and as a result the effective length of the pump stroke is correspondingly reduced. Thus, continuous minute adjustments may be made in the amount of liquid metered by the pump in each of its cycles of operation. Of course, the second nut 110 is merely to lock the first such nut 108 in its position of adjustment.

As will now be understood, the described apparatus operates as a contact applicator for applying various liquid media to surfaces of workstock or workpieces moved continuously or intermittently between the two rollers 12 and 14. In this regard, the preferred form of roller shown and described in conjunction with FIG. 7 has definite advantages, in that it facilitates reliable, continuous, trouble-free distribution of the precisely metered liquid onto the outer roller surface, for transfer to even irregularly shaped or uneven workpieces by rolling contact with them. Further, the described resiliently compressible felt or open-celled polymeric foam outer cover 52 facilitates the overall uniformity and controlled dispersion of the liquid sprayed outwardly from internal roller tube 68, which passes outwardly to the cover through the numerous openings in the perforated cylinder 50. Of course, controlled operation of the actuating cylinder 34 may impart greater or lesser degrees of resilient compressive deformation of outer cover 52, whose thickness may vary from one application to another as a function of, and to best accommodate, the particular circumstances involved, and in this manner the liquid to be distributed may be applied at various depths to irregular or undulating surfaces of sheet stock or individual workpieces passing by in contact with the outer cover. Of course, such rolling deformation of the cover 52 also enhances the continuous distribution and redistribution of liquid through it in a uniformly dispersed manner, due to what is in effect capillary action within the minute passages extending throughout the cover.

The convenient precise control afforded by the preferred positive-displacement pump 72 facilitates the operational capability noted above, since it provides for ready adjustability as well as consistent precise control of the amount of liquid carried by the outer roller portion or cover 52. As a result, the application of liquid to the workpiece is always in the desired amount, and is always synchronized with the particular feed rate of the workpiece, increasing or decreasing automatically with feed rate. The preferred roller configuration insures that the liquid to be dispensed is distributed uniformly across the width of the roller for equal application to all parts of the workpiece, and in fact the modular configuration of the apparatus enables the system to apply different quantities of the liquid to different areas across the width of the workpiece in the event that is desired, since each different module may employ a different pump or metering orifice which may be adjusted for a different amount of liquid delivery that the other roller receives. At the same time the accurate liquid control provided by the system greatly reduces or eliminates throw-off or other inadvertent, extraneous dissipation of the liquid at the point of application, since an excess supply at the roller may be eliminated by proper adjustment of the system. Thus, little cleanup is required, and there is no excess liquid to be recovered, recirculated, or otherwise treated. This provides a cleaner work area, reduces waste and corresponding expense, and essentially eliminates an area of enviromnental concern. In addition, it enables increased production rates as well as improved product quality and lower overall system maintenance.

As may be perceived from the forgoing, the apparatus and system in accordance with the invention is particularly well-adapted to the application of liquid lubricants to sheet metal stock in metalworking operations such as punching, stamping, fine blanking, roll forming, etc., but it is also of considerable advantage in other such industrial processes and the like, e.g., application of various finished, protective coatings, etc.

The foregoing description is of preferred embodiments only, and it will be readily appreciated by those skilled in the art that modifications may be made to such embodiments, and the invention may be implemented in other particular ways without departing from the concepts disclosed. All such modifications and other embodiments are to be considered as included in the following claims, unless these claims by their language expressly state otherwise.

The embodiments of the invention in which an exclusive property of privilege is claimed are defined as follows:

1. A contact applicator for applying liquid to a workpiece surface, comprising in combination:

at least one applicator member comprising a freely rotatable roller having a cylindrical outer wall with an outer surface arranged to contact advancing workpieces and be moved thereby to rotate said roller while transferring liquid to the surface of such workpieces by contact therewith;

a source of said liquid, a controllable liquid-dispensing apparatus which provides predetermined quantities of said liquid from said source, and a conduit for conveying said discharged quantities of liquid to said roller;

control apparatus operatively coupled between said roller and said dispensing apparatus to control said dispensing apparatus in response to rotational movement of said roller caused by said advancing workpieces, such that the quantity of liquid discharged from said source and conveyed to said roller is related directly to advancement of said workpieces;

said roller having a predetermined width and an outer portion of deformably compliant material extending across said width for contacting said workpieces and thereby carrying said liquid into contact with said workpieces; and a series of spray orifices disposed inside said roller and across its width, said orifices receiving said conveyed liquid and discharging it into the interior of said roller and generally toward said cylindrical outer wall for contact with the inside periphery of said cylindrical outer wall;

said cylindrical outer wall of said roller having sufficient liquid transferring capability to pass the liquid applied to its inside periphery to and across the outside periphery of said roller when said applicator is positioned to place the outside of said roller in moving contact with said workpieces, whereby said roller continuously transfers said liquid to said workpieces by surface contact in amounts which are directly related to the advancement of the workpieces.

2. A contact applicator according to claim 1, wherein said liquid-dispensing apparatus has a variably adjustable output for selectively varying the quantity of liquid dispensed during progressive increments of roller rotation corresponding to workpiece advancement.

3. A contact applicator according to claim 1, wherein said roller has a generally tubular liquid-carrying supply member extending across its width internally thereof, said supply member being coupled in flow communication with said conduit conveying said quantities of liquid and also with said series of spray orifices to transfer said liquid therebetween.

4. A contact applicator according to claim 1, wherein said at least one applicator member includes a pair of said rollers disposed in longitudinal alignment with one another and in closely spaced relation to receive and pass a workpiece therebetween, and wherein each of said rollers includes a series of said internal spray orifices coupled to receive said conveyed liquid, whereby each of said rollers apply said liquid to an opposite side of said workpieces during advancement thereof.

5. A contact applicator according to claim 4, wherein said liquid-dispensing apparatus is arranged to provide substantially the same predetermined quantity of said liquid to each of said rollers.

6. A contact applicator according to claim 1, wherein said control apparatus includes an actuator which is operatively coupled to said roller so as to actuate said liquid-dispensing apparatus in response to the extent of roller rotation.

7. A contact applicator according to claim 6, wherein said actuator is disposed adjacent said roller to directly detect and monitor roller rotation.

8. A contact applicator according to claim 7, wherein said roller includes an actuation structure for physically contacting and moving at least a portion of said actuator during roller rotation to thereby correspondingly control said dispensing apparatus.

9. A contact applicator according to claim 8, wherein said actuation structure of said roller includes a cam surface which moves during roller rotation.

10. A contact applicator according to claim 9, wherein said cam surface comprises a rotary cam disposed at one end of said roller.

* * * * *